US005235834A

United States Patent [19]

Bolkey et al.

[11] Patent Number: 5,235,834

[45] Date of Patent: Aug. 17, 1993

[54] CONTROL SYSTEM AND METHOD FOR SWITCHING PIVOT STANDS IN A TANDEM ROLLING MILL

[75] Inventors: Harold B. Bolkey, Fairview; Thomas J. Morrow, Pittsburgh, both of Pa.

[73] Assignee: AEG Automation Systems Corporation, Oakdale, Pa.

[21] Appl. No.: 764,318

[22] Filed: Sep. 23, 1991

[51] Int. Cl.[5] ..... B21B 37/00

[52] U.S. Cl. ..... 72/6; 72/14; 72/29; 72/234

[58] Field of Search ..... 72/6–8, 72/14, 19, 28, 29, 205, 234; 364/469, 472, 476

[56] References Cited

U.S. PATENT DOCUMENTS

| | | | |
|---|---|---|---|
| 1,871,437 | 8/1932 | Winne | 72/29 |
| 3,030,836 | 4/1962 | Gochenour | 72/234 |
| 3,036,480 | 5/1962 | Schwab | 72/234 |
| 3,212,310 | 10/1965 | Brys | 72/12 |
| 4,011,743 | 3/1977 | Peterson et al. | 364/469 |
| 4,998,427 | 3/1991 | Peterson et al. | 72/14 |

FOREIGN PATENT DOCUMENTS

| | | | |
|---|---|---|---|
| 0007313 | 1/1982 | Japan | 72/6 |
| 0086920 | 5/1983 | Japan | 72/234 |
| 0240327 | 11/1985 | Japan | 72/6 |
| 537723 | 12/1976 | U.S.S.R. | 72/14 |

*Primary Examiner*—Lowell A. Larson
*Assistant Examiner*—Thomas C. Schoeffler
*Attorney, Agent, or Firm*—Richard V. Westerhoff; Suzanne Kikel

[57] ABSTRACT

In a master speed regulator system for a multi-stand rolling mill, a control system and method for switching a pivot stand via a bumpless transfer back and forth from the second stand to the last stand depending on the phases of the mill and while the mill is operating. A microprocessor is used for recalculating the master speed reference B1, the integral values for the master speed reference integral controller, and the outputs for the tension/automatic gauge integral controllers for the new pivot state based on conditions of the previous pivot state.

14 Claims, 3 Drawing Sheets

CONTROL SYSTEM AND METHOD FOR SWITCHING PIVOT STANDS IN A TANDEM ROLLING MILL

BACKGROUND OF THE INVENTION

1. Field of the Invention

This invention relates to selectively switching back and forth from an entry stand to an exit stand both acting as pivot stands at different time intervals in the mill during the several phases when rolling strip material.

2. Description of the Prior Art

A master speed regulation system for a multi-stand rolling mill is normally controlled by applying a speed reference to a pivot stand, whose speed remains constant at the previously scheduled rate, and cascading that speed reference, which is adjusted for automatic gauge control and tension control, to the stands upstream and downstream from the pivot stand depending on whether the mill is in a threading/tailing stage (low speed) or in a full run stage (high speed).

The pivot stand establishes coordination of the various stand speeds relative to each other. The choice of which stand to make the pivot stand effects the operation of the mill, that is, a pivot stand at the entry end of the mill improves the ability to thread the mill since the tension corrections are cascaded to the threading stand, and are not reflected to the upstream stand or stands through which the strip material has been threaded. Generally, the tension corrections cause the speeds of the downstream stands (having no strip) to be increased during the threading of the strip.

Once threading has been accomplished, however, and the mill is in its full run stage, a pivot stand at the exit end of the mill is more desirable. Under these conditions, the automatic gauge control system and the tension control system are prevented from changing the speed of the exit stand of the mill, resulting in a constant tension between the mill and the tension reel, and allowing the exit stand to operate at optimum velocity for production purposes.

It is undesirable to thread with the exit stand as the pivot stand. The natural tendency for each stand as the strip enters is a speed decrease due to load impact. This speed decrease is reflected through the tension regulators as a disturbance to all upstream stands. If the threading speed is sufficiently slow a stand may even reverse its direction and cause a strip break.

Historically, a compromise was developed especially in a five stand mill, where stand three was chosen as the pivot stand for the several stages of the mill. However, due to the differences in the mill characteristics between threading a mill and operating at the optimum running speed, a pivot stand at the entry end for threading and at the exit end for full run is still the most desirable arrangement since this setup results in optimum speed control for the several stages of the mill. In order to obtain this optimum speed control, it is desirable to be able to smoothly transfer back and forth between the entry stand acting as the pivot stand in the threading and/or tailing out of the strip and the exit stand acting as the pivot stand in the full run phase of the mill without disturbing the existing mill conditions.

SUMMARY OF THE INVENTION

The present invention has solved the above described problems by providing a control system for automatically selecting a pivot stand at the entry end for threading, switching to an exit stand for full run, and back to an entry stand for tailing out, thereby allowing the mill to be set up for the threading of a new strip.

In accordance with the invention there is provided in a tandem rolling mill having master speed regulation, tension regulation by speed and roll gap control, and automatic gauge control, a means of choosing either of two stands as the pivot stand, that is, the stand to which the master speed reference is applied based upon operating conditions in the mill, and a means of transferring the control to another pivot stand as operating conditions change. This is done through a bumpless transfer i.e. without abruptly changing the speed reference to any stands in the mill as the transfer from one pivot stand to the other pivot stand occurs.

If the tandem mill is a five stand mill, stand two acts as the pivot stand during threading. When threading is completed which is triggered by the tension being established at the tension reel, stand five acts as the pivot stand for the full run stage. For tailing out, the control system switches back to stand two as the pivot stand. This involves at the transfer point the recalculation of various values and equations used in the rolling process.

For instance, as the threading is being completed with stand two being the pivot stand, the master speed reference, the interim terms in the integral equation for the master speed reference, and the integral output and limits for the tension/automatic gauge controllers between the stands are recalculated based on present conditions in the mill and are then used as the initial conditions for stand five now acting as the pivot stand. As the strip exits the mill, a transition back to a stand two pivot state is accomplished by again recalculating the master speed reference, the interim terms in the integral equation for the master speed reference, and the integral output and limits for the tension/automatic gauge controllers between the stands, which are based on the present conditions in the mill, and are then used as the initial conditions for the stand two pivot state.

The result is a bumpless transfer from stand two to stand five and back to stand two, which stands act as the pivot stand at different times for the several mill phases. By automatically changing the pivot stand according to the teachings of the invention from stand two to stand five and back to stand two, the coordinated speeds of the stands are adjusted to facilitate ease in threading and tailing and in gauge control.

It is, therefore, an object of the invention to provide a control system and method for selecting a stand adjacent an entry end of the mill as a pivot stand during a first operating mode for said mill, and a stand adjacent an exit end of the mill as a pivot stand during a second operating mode for said mill, and to maintain the mill conditions existing in the mill after the transfer from the first operating mode to the second operating mode and from the second operating mode to the first operating mode.

These and other objects of the invention will be more fully understood from the following description of the invention, on reference to the illustrations appended thereto.

DETAILED DESCRIPTION OF A PREFERRED EMBODIMENT

Figure 1:
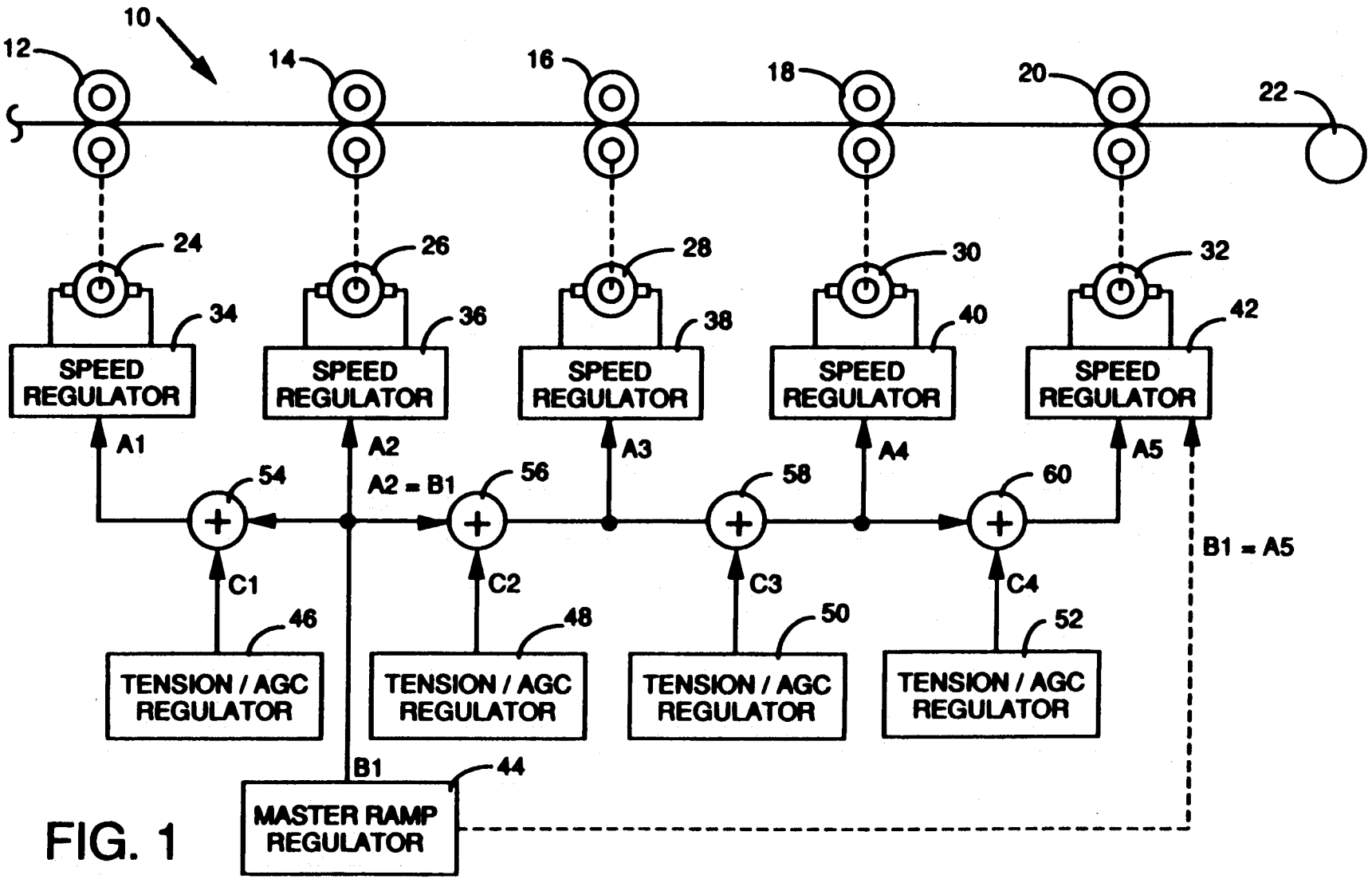
FIG. 1 is a schematic block diagram of the control system where stand two is the pivot stand.
Figure 2:
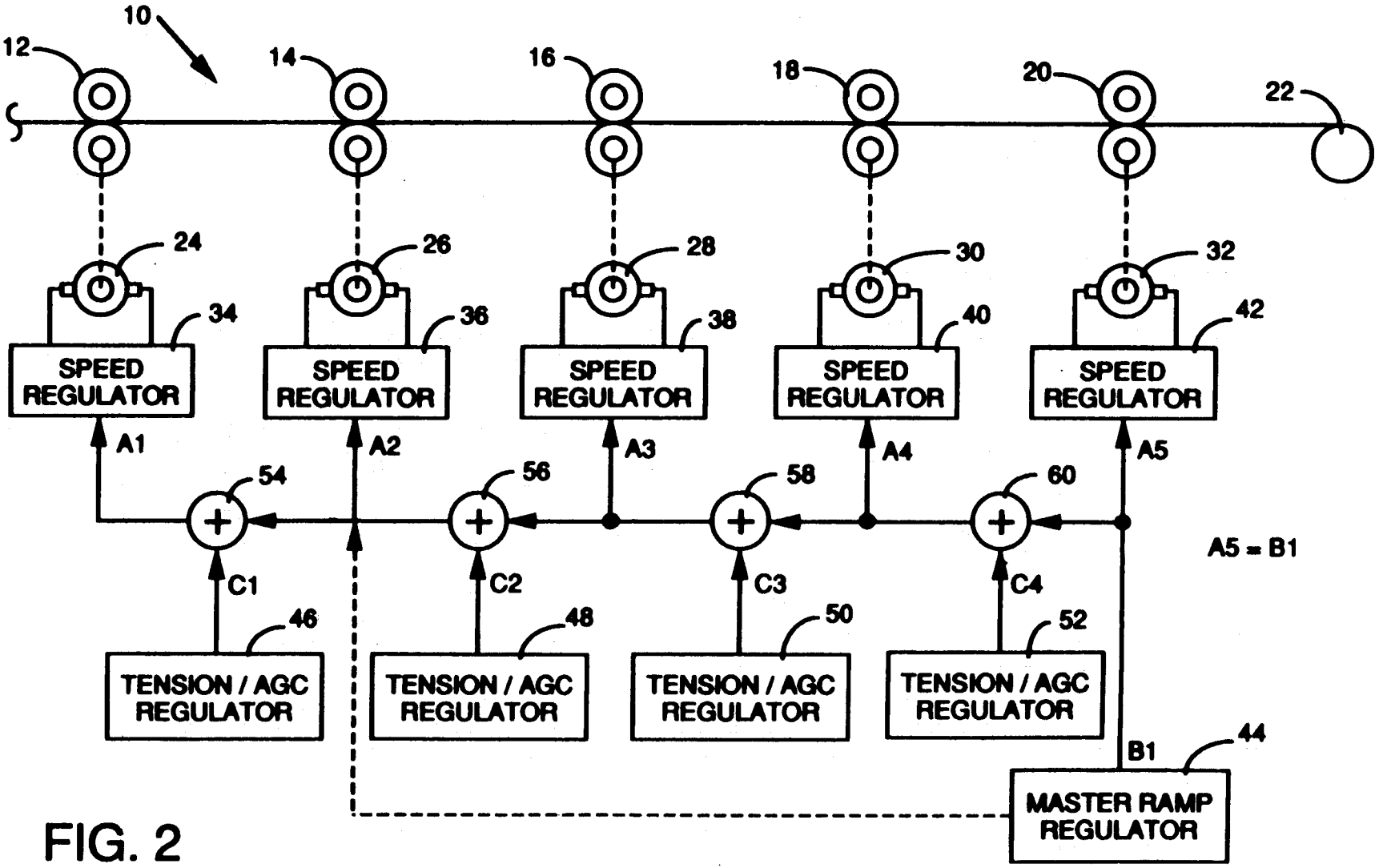
FIG. 2 is a schematic block diagram of the control system where stand five is the pivot stand.

With reference to FIGS. 1 and 2, there is shown a five stand tandem rolling mill 10 for rolling cold strip material. This mill comprises stands 12, 14, 16, 18 and 20 and a tension reel 22. In the normal operation of the mill, strip material to be rolled is passed between the rolls of the successive stands starting with stand 12 and is progressively reduced in gauge while the speed of the strip material increases at the output of each stand. The rolls for each of the stands are provided with drive motors 24, 26, 28, 30, and 32 respectively. Motors 24–32 are controlled by speed regulators 34, 36, 38, 40 and 42, respectively which receive a speed reference signal designated as A1, A2, A3, A4 and A5, respectively. It is generally known in the art that in a pivot stand, the speed of the rolls for that stand remains constant at the previously scheduled rate, and the speeds of the remaining stands are adjusted to this constant speed.

In FIG. 1, the pivot stand is shown as being the second stand and is designated at 14. Preferably, the arrangement of FIG. 1 is used during threading and tailing of the strip. In FIG. 2, the pivot stand is shown as being the fifth stand identified at 20. Preferably, this arrangement is used for the full run phase of the mill. For the pivot stand in FIGS. 1 and 2, the speed reference A2, A5, respectively is a direct output B1 of a master ramp regulator 44. This relationship is indicated in FIG. 1 where A2 is set equal to B1, and in FIG. 2 where A5 is set equal to B1.

For all the other speed regulators which are not associated with the pivot stand 2 in FIG. 1 and the pivot stand 5 in FIG. 2, the speed reference is the sum of the output B1 of master ramp regulator 44, and the output of any applicable tension/automatic gauge control regulator 46, 48, 50, and 52.

For example, in FIG. 1, the speed reference to speed regulator 42 for stand 20 (the fifth stand) is the output B1 of master ramp regulator 44 plus outputs C2, C3, and C4 of tension/automatic gauge control regulators 48, 50, and 52, respectively. This resultant signal is identified as A5 in FIG. 1. The speed reference to speed regulator 40 for stand 18 is the output B1 of ramp regulator 44 plus the outputs C2 and C3 of tension-/automatic gauge control regulators 48 and 50, respectively. The resultant signal is identified at A4. The speed reference for speed regulator 38 for stand 16 is output B1 of master ramp regulator 44 plus the output C2 from tension/automatic gauge control regulator 48. The resultant signal is identified at A3. The speed reference for speed regulator 34 for stand 12, the first stand, is output B1 of master ramp regulator 44 plus the output C1 from tension/automatic gauge control regulator 46. The resultant signal is identified at A1.

These resultant signals A1, A3, A4 and A5 are produced at summing junctions 54, 56, 58, and 60. respectively. Summing devices for performing these calculations are well-known in control systems for rolling mills. The arrows indicate the direction for the outputs of regulators 44–50. As is the normal operation for a pivot stand at the entry end, the tension corrections are cascaded downstream from stand 14 for threading and tailing.

As stated hereinbefore, the arrangement of FIG. 1 is generally for the threading or tailing phase of the mill, where, as can be seen, stand 14, the second stand of the mill is used as the pivot stand. Tension/automatic gauge control regulators 46–52 provide adjustments to master ramp regulator 44 to control the tension between the stands 12–20 to a tension setpoint for the threading operation. In this arrangement of FIG. 1, where stand 14 is the pivot stand, the threading process is improved because the tension corrections are cascaded downstream to only the threading stand and are not reflected back to the stands with strip. Generally, the cascading of the tension corrections causes the speeds of the downstream stands 16–20 to increase on threading of the strip. Once tension is established on tension reel 22, the control system causes the mill to transfer to the full run stage where the fifth stand, stand 20, becomes the pivot stand.

FIG. 2 illustrates a control system for the mill 10 where stand 20, the exit stand, is the pivot stand. The output B1 from master ramp regulator 44 goes directly into speed regulator 42 controlling the motor 32 for stand 20. The output A5 of master ramp regulator 44 is shown as being equal to B1. The speed reference A4 to speed regulator 40 for stand 18 now becomes the output B1 of ramp regulator 44 plus the output C4 of tension-/automatic gauge control regulator 52. The speed reference A3 for speed regulator 38 for stand 16 now becomes output B1 from ramp regulator 44 plus outputs C3 and C4 from tension/automatic gauge control regulators 50 and 52, respectively. The speed reference A2 for speed regulator 36 for stand 14 now becomes output B1 from regulator 44 plus outputs C2, C3, and C4 from regulators 48–52, respectively. For stand 12, the first stand, the speed reference A1 now becomes output B1 plus outputs C1, C2, C3 and C4 from regulators 46–52, respectively.

In the control system of the arrangement of FIG. 2, it can be seen that the tension/automatic gauge control regulators 46–52 provide adjustments to the output signal of master ramp regulator 44 to control the output gauge of the mill to a specific setpoint by adjusting the speed reference to speed regulators 34–42 controlling the speed of stands 12–18, and ramp regulator 44 controlling the output of speed regulator 42 controlling the speed for stand 20, the pivot stand. The direction for the output for master ramp regulator 44 and that from and as a result of regulators 46 and 48–52 are shown by the arrows. The tension corrections are cascaded upstream from pivot stand 20 to stands 12–18.

With the pivot stand now being located at the exit end of the mill a constant tension exists between stand 20 and tension reel 22 since the automatic gauge control and tension control systems 46–52 in the mill are prevented from changing the speed of exit stand 20. This allows the exit stand 20 to operate at optimum velocity resulting in increased production. For tin or light sheet product the exit stand would normally be preset at maximum allowable speed to obtain optimum production. By not including a correction for tension or automatic gauge control, the preset speed can be set at full motor speed. As was stated hereinbefore, the arrangement of FIG. 2 with stand 20 as the pivot stand represents the control system for mill 10 during the full run phase of the mill.

During the tailing out phase for the strip material, the control system of mill 10 switches back to the arrangement of FIG. 1 where stand 14 is now the pivot stand. This places the mill in both a tailing out phase for the old strip and a threading operation for the new strip which is to be rolled in succession.

Figure 3:
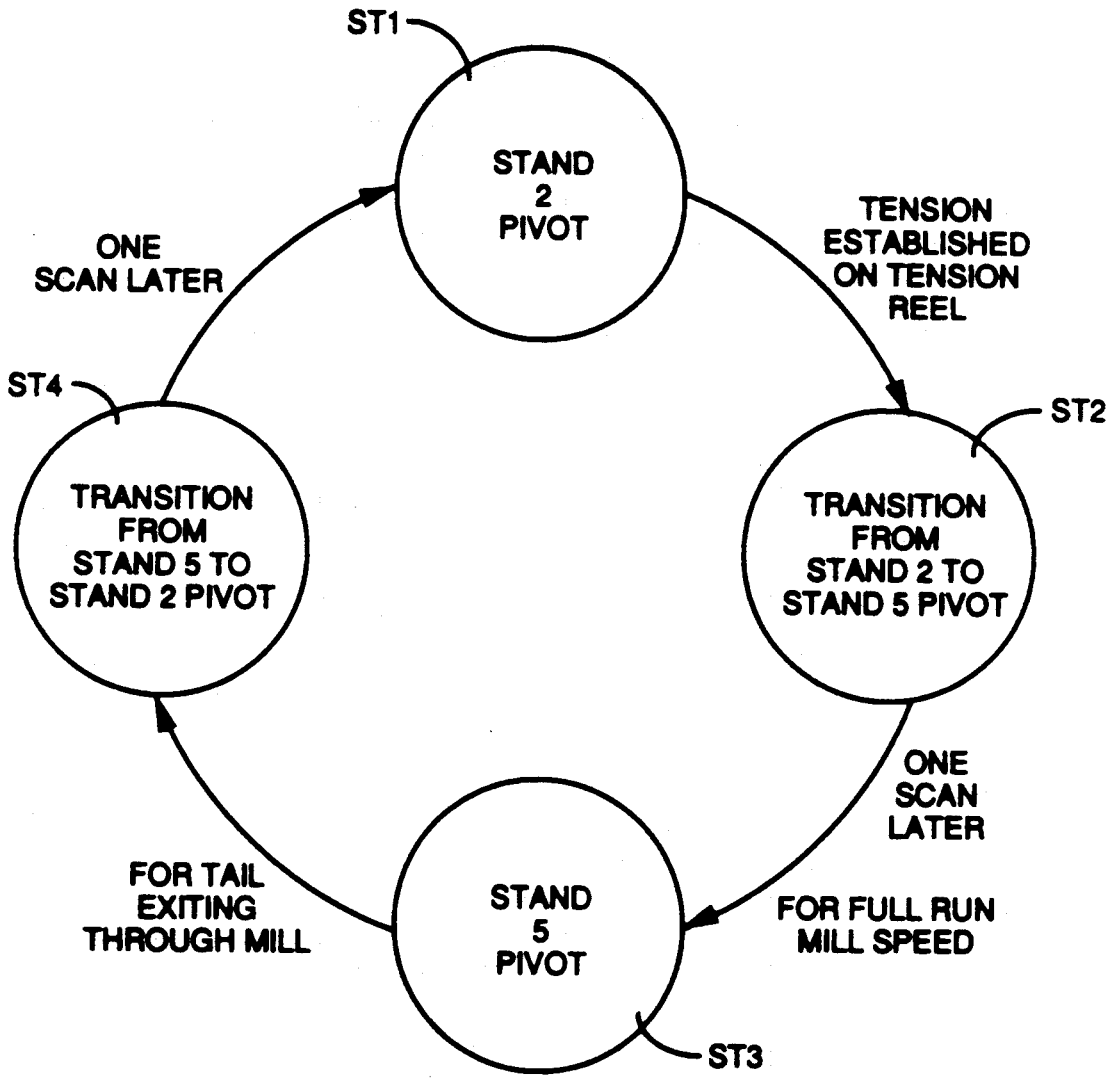
FIG. 3 is a schematic state diagram of the logic for the system in its determination of the pivot stand for FIGS. 1 and 2.

FIG. 3 illustrates a diagram of the various states for the pivot stand and the logic involved in determining the transition from one pivot stand to the other pivot stand of in FIGS. 1 and 2.

Initially, in particularly referring to FIGS. 1 and 3, as the strip material is threaded through mill 10 the control system for the mill is in a stand two pivot stage designated in FIG. 3 as ST 1. As the strip material is threaded onto tension reel 22, and tension is established between reel 22 and stand 20, the state machine logic causes the control system to change to the "Transition from Stand 2 Pivot to Stand 5 Pivot" state designated in FIG. 3 as ST 2. During the one execution cycle (milliseconds) where the state machine is in ST2, the following steps are being performed in the control system:

Step 1. The output B1 of master ramp regulator 44 is redirected to become the input for speed regulator 42 for stand 20, the exit stand. This is shown in phantom in FIG. 1.

Step 2. Master ramp regulator 44 is preferably an integral regulator. For a bumpless transfer from stand 14 as the pivot stand to stand 20 as the pivot stand, the integral function of ramp regulator 44 is redefined based on a value equal to the instantaneous input A5 of stand 20, which is a sum result or output of summing junction 60 of FIG. 1. In a digital computer which is part of the control system, the following integral equation is solved:

$$V_n = \text{inc}(E_n + E_{n-1}) + V_{n-1} \quad (1)$$

where, $V_n$ = integral output $V_{n-1}$ = previous integral output $E_n$ = integral input $E_{n-1}$ = previous integral input inc. = (processor scan time)/2(integral time constant)

The above equation No. 1 represents a general form used in an integral computer, and is representative of a trapezoidal type of integration, well-known in the art. The $V_n$ and $V_{n-1}$ terms are velocity references and the $E_n$ and $E_{n-1}$ terms are acceleration references.

As can be seen from equation No. 1, the present value for $V_n$ is being updated by the instantaneous values of $E_{n-1}$ and $V_{n-1}$.

As the transition from stand two pivot to stand five pivot state is being computed during the n−1 execution cycle to state ST3 "stand five pivot", $V_{n-1}$ in equation No. 1 is set equal to A5 which is the output coming at the moment from junction 60 in FIG. 1. This is reflected in the value for $V_n$ in equation No. 1.

The value of $V_n$ from equation No. 1 becomes the output B1 of master ramp regulator 44 for FIG. 2 shown in hardline in FIG. 2.

Step 3. The outputs C1–C4 of tension/automatic gauge control regulators 46–52, respectively for the arrangement of FIG. 2, are calculated as follows:

$$C4 = A4 - A5 \quad (2)$$

$$C3 = A3 - A4 \quad (3)$$

$$C2 = A2 - A3, \text{ and finally} \quad (4)$$

$$C1 = A1 - A2 \quad (5)$$

The values of C1–C4 in equation Nos. 2–5 are based on the previous values of A1–A5 of the arrangement of FIG. 1. During the transition period ST2 the variables A1–A5 in equation Nos. 2–5 are held constant, and the outputs C1–C4 are changed in one execution cycle in preparation for the arrangement of FIG. 2.

As is known in the art, tension/automatic gauge control regulators 46–52 have internal integrators based on speed. The previous integrator output for each regulator 46–52 is redefined based on the calculations for C1–C4 obtained in step 3.

The order of elements A1–A5 in equations 2–5 represents the direction of the cascading effect of master ramp regulator 44 of FIG. 1.

Referring again to FIG. 3, at the end of the computer execution cycle for ST2, the state machine changes to "Stand 5 Pivot" state designated as ST3. At this time regulators 44, 46, 48, 50, and 52 are active again, that is, they are operating under the normal mode for tension control where the outputs C1–C4 and inputs A1–A4 are changing. Master ramp regulator 44 operates to maintain a constant speed for stand 20. As can be seen in FIG. 3, states ST2 and ST3 are for the full run speed of the mill where most of the strip reduction is to be performed.

As the strip material exits mill stands 12–20, which is legended in FIG. 3 as "Tail Exiting Through Mill", the state machine transfers to the ST4 state, which is legended as "Transition from Stand 5 to Stand 2 Pivot". During the one execution cycle that the state machine is in ST4 the following steps in the digital computer are performed:

Step 4. The output B1 of master ramp regulator 44 is redirected to become the input for speed regulator 36 for stand 14, stand two. This is shown in phantom in FIG. 2.

Step 5. As stated hereinbefore, master ramp regulator 44 is preferably an integral regulator. For a bumpless transfer from pivot stand 20 to new pivot stand 14, the integral function of regulator 44 is redefined based on a value equal to the instantaneous input A2 of stand 14, which is the sum result or output of summing junction 56 in FIG. 2. This is similar to the action taken in the transition from stand 14 to stand 20 with equation No. 1 in step 2 being performed, where $V_{n-1}$ is set equal to A2, the output of junction 56 in FIG. 2 at the moment in the execution cycle.

Step 6. The outputs C1–C4 of tension/automatic gauge control regulators 46–52, respectively, for the arrangement of FIG. 1, are calculated as follows:

$$C1 = A1 - A2, \quad (6)$$

$$C2 = A3 - A2, \quad (7)$$

$$C3 = A4 - A3, \text{ and finally} \quad (8)$$

$$C4 = A5 - A4 \quad (9)$$

The values of C1–C4 in equation Nos. 6–9 are based on the previous values of A1–A5 of the arrangement of FIG. 2. During the transition period ST4, the variables A1–A5 in equation Nos. 6–9 are held constant, and the outputs C1–C4 are changed in one execution cycle in preparation for the arrangement of FIG. 1 where stand 14 is to act as the pivot stand. The previous integrator output for each regulator 46–52 is redefined based on the calculations for C1–C4 obtained in Step 6. The order of elements A1–A5 in equations 6–9 represents the direction of the cascading effect of master ramp regulator 44 in FIG. 2.

At the end of the computer execution cycle for ST4, the state machine changes back into a stand 2 pivot state ST1 for the exiting of the strip material now in the mill and the threading of a new strip. Regulators 44–52 are active again in that they are under the normal mode for tension control where outputs C1–C4 and inputs A1–A4 are changing. Ramp regulator 44 operates to maintain a constant speed for stand 14.

The invention can be accomplished by using analog components, but it is preferred to use microelectronic technology. The calculation and recalculation of B1, in FIGS. 1 and 2, the calculation and recalculation of C1–C4 in FIGS. 1 and 2, and the overall operation of the invention can be done by a microprocessor. This can be easily implemented by those skilled in the computer and mill control technology in view of the above teachings of the invention. By using microelectronic technology, the stand acting as the pivot stand can automatically and almost instantaneously be switched between stand two and stand five via a bumpless transfer. As can be appreciated from the foregoing, this bumpless transfer is accomplished by recalculating the terms of the various equations for outputs B1, C1, C2, C3 and C4 at the time of transfer from one pivot stand to the other. The pivot stand is automatically changed while rolling with the coordinated speeds of the stands being readjusted to facilitate ease in threading and gauge control.

The master ramp regulator 44 and regulators 46, 48–52 are well-known devices. They could be analog devices or a program in the main system of the mill. Preferably, in the invention, regulator 44 is implemented in a microprocessor. As is known, in regulator 44 an error between the desired speed reference and the actual speed reference is ramped and delayed to provide an input to an integrator device with limits in regulator 44. The output of the integrator device, which preferably is a proportional integrator which is known in the industry, is delayed to provide a master speed reference to the drives in a well-known manner.

The mill arrangement of the drawings is comprised of existing components in a mill for rolling generally cold strip products, such as light gauge tinplate strip, and operates in a well-known manner for reducing the strip product. A computer program for following the teaching of the invention are easily incorporated into the microprocessor of the main control system for the mill. As stated hereinabove to one skilled in the art, and based on the teachings of the invention, means for recalculating B1, C1, C2, C3, and C4 can easily be devised.

Whereas a particular embodiment of the invention has been described above for purposes of illustration, it will be evident, to those skilled in the art that numerous variations or details may be made without departing from the invention as defined in the appended claims.

We claim:

1. In a continuous rolling mill for rolling strip material, said mill having a threading operation, a full run operation, and a tailing operating, comprising:

at least two roll stands operating at a predetermined speed, one of said stands adjacent an entry end and a second of said stands adjacent an exit end for said mill, and control means for controlling said mill, including first means for selecting and causing said one stand adjacent said entry end to act as a pivot stand during said threading operation and said tailing operation of said mill, second means for transferring control of said mill and selecting and causing said second stand adjacent said exit end to act as said pivot stand during said full run operation of said mill, and third means for causing said speed of said second stand to be the same speed as said speed of said one stand when said second means of said control means is in operation and said speed of said one stand to be the same as said speed of said second stand when said first means of said control means is in operation.

2. In a continuous rolling mill for rolling strip material and having at least three stands being driven at a speed and one of said stands being adjacent an entry end and a second being adjacent an exit end for said mill, comprising:

control means for controlling said mill with said stand adjacent said entry end acting as a pivot stand during a threading or a tailing operation of said mill and transferring while said mill is in operation to controlling said mill with said stand adjacent said exit end acting as a pivot stand during a full run operation of said mill, said control mean comprising;

master speed regulator means for obtaining a master speed reference value as an output for regulating said speed of each of said stands, and having an integral controller for establishing an instantaneous speed for one of said stands acting as said pivot stand and for constantly updating said master speed reference value, said master speed regulator means including means for recalculating said master speed reference value for said pivot stand adjacent said exit end based on said master speed reference value of said pivot stand adjacent said entry end, and for recalculating said master speed reference value for said pivot stand adjacent said entry end based on said master speed reference value of said pivot stand adjacent said exit end, means for redirecting said output of said master speed regulator means from said pivot stand adjacent said entry end to said pivot stand adjacent said exit end and from said pivot stand adjacent said exit end to said pivot stand adjacent said entry end, speed regulator means having means for producing an output and for receiving an input and associated with each of said stands and with said master speed regulator means for regulating said speed of said each of said stands, and tension and automatic gauge control means having means for producing an output and associated with each of said speed regulator means of said each of said stands and having an integral controller, and including means for recalculating said output of said tension and automatic gauge control means for said full run operation of said mill based on said input to said speed regulator means of said each of said stands during said threading or tailing operation for an upstream stand and a downstream stand relative to a said tension and automatic gauge control means.

3. In a mill of claim 2, wherein said control means further comprises:

means for activating said means for recalculating said master speed reference value and said outputs of said tension and automatic gauge control means values during a transition period from entry end stand acting as said pivot stand, and during a transition period from said exit end stand acting as said pivot stand to said entry end stand acting as said pivot stand, and while said mill is in operation.

4. In a mill of claim 2, wherein said control means further comprises means for directly using said master speed reference value for controlling said speed regulator means of one of said stands acting as said pivot stand, and means for combining said master speed regulator reference value with said output of each of said tension and automatic gauge control means for controlling said speed regulator means of said each of said stands located downstream and upstream relative to said entry end stand when said entry end stand acts as said pivot stand, and for combining said master speed reference value with said output of said each of said tension and automatic gauge control means for controlling said speed regulator means of said each of said stands located upstream relative to said exit end stand when said exit end stand acts as said pivot stand.

5. In a mill of claim 2, wherein said means for recalculating said master speed reference value includes means for defining said output of said master speed regulator means based on the following equation:

$$V_n = \text{inc.}(E_n + E_{n-1}) + V_{n-1}$$

where, $V_n$ = integral output $V_{n-1}$ = previous integral output inc. = (processor scan time)/2 (integral time constant)

$E_n$ = integral output, and $E_{n-1}$ = previous integral input and, wherein said $V_{n-1}$ term is used as an instantaneous value for said master speed regulator means for said one of said stands acting as said pivot stand during said threading, tailing and full run operations of said mill.

6. In a mill of claim 2, wherein said means for recalculating said outputs of said tension and automatic gauge control means further includes means for calculating the difference between said inputs to said speed regulator means for said upstream and said downstream stands based on whether said master speed reference value is being applied upstream of downstream of the mill relative to said one of said stands acting as said pivot stand.

7. A method for operating a continuous rolling mill in a first mode of operation and a second mode of operation, wherein said first mode of operation is a threading operation or a tailing operation and said second mode of operation is a full run operation for said mill, said mill having at least three stand with a stand adjacent an entry end and a stand adjacent an exit end, said stands being driven at a speed, the steps comprising:

during said threading and tailing operation of said mill, selecting said stand adjacent said entry end as a pivot stand, and during said full run operation of said mill, selecting said stand adjacent said exit end as said pivot stand.

8. A method of claim 7, wherein said mill comprises at least five stands, the steps further comprising:

during said threading or tailing operation of said mill, selecting a second stand as said pivot stand, and during said full run operation of said mill selecting a last stand as said pivot stand.

9. A method of claim 7, the steps further comprising:

after said transferring of said mill from said first operating mode to said second operating mode and from said second operating mode to said first operating mode, operating said stand adjacent said entry end and said stand adjacent said exit end at a same speed prior to said transferring step.

10. A method of claim 7, wherein said mill further comprises master ramp regulator means for obtaining a master speed reference value as an output for each said stands and for regulating the speeds of each said stands and having means for producing an output, speed regulator means for each said stands for regulating said speed of each individual stand and including means for receiving an output, and tension and automatic gauge control means associated with said each stands and including means for producing an output, the steps further comprising:

during a transition period from said first operating mode where said entry end stand is acting as said pivot stand to said second operating mode where said exit end stand is acting as said pivot stand, and while said mill is operating, redirecting said output of said master ramp regulator means from said entry end pivot stand to said exit end pivot stand.

recalculating said the output of said master ramp regulator means for said exit end pivot stand based on the master speed reference value of said entry end pivot stand, and recalculating said output of said tension and automatic gauge control means for each stand based on said input to said speed regulator means for an upstream stand and a downstream stand relative to a respective said tension and automatic gauge control means.

11. A method of claim 10, the steps further comprising:

directly using said master ramp reference value for controlling the speed regulator means of said pivot stand, combining said output of said master ramp regulator means with said output of said tension and automatic gauge control means for controlling said speed regulator means of said stands located downstream and upstream relative to said pivot stand when said pivot stand is adjacent said entry end, and combining said master ramp reference value with said output of said tension and automatic gauge control means for controlling said speed regulator means of said stands located upstream relative to said pivot stand when said pivot stand is adjacent said exit end.

12. A method of claim 10, the steps further comprising:

during a transition period from said second operating mode to said first operating mode and while said mill is operating, redirecting said output of said master ramp regulator means from said exit end pivot stand to said entry end pivot stand, recalculating said output of said master ramp regulator means for said entry end pivot stand based on said master speed reference value of said exit end pivot stand, and recalculating said output of said tension and automatic gauge control means for each stand based on said input to said speed regulator means for an upstream stand and a downstream stand relative to a respective said tension and automatic gauge control means.

13. A method of claim 12, the steps further comprising:

redefining said output of said master ramp regulator means based on the following equation:

$$V_n = \text{inc.}(E_n + E_{n-1}) + V_{n-1}$$

where $V_n$ = integral output $V_{n-1}$ = previous integral output $E_n$ = integral input $E_{n-1}$ = previous integral input inc. = (processor scan time)/2(integral time constant)

said $V_{n-1}$ term being used as a present value for said master ramp regulator means for the respective output stand in one of said modes.

14. A method of claim 12, the steps further comprising:

calculating a difference between said inputs to said speed regulator means for said upstream stand and said downstream stands based on whether said master speed reference value is being applied to an upstream stand or to a downstream stand relative to said pivot stand, and employing said difference to represent new output values for said tension and automatic gauge control means when said mill operates in said first and said second operating modes.

* * * * *

UNITED STATES PATENT AND TRADEMARK OFFICE

CERTIFICATE OF CORRECTION

PATENT NO. : 5,235,834

DATED : August 17, 1993

INVENTOR(S) : Harold B. Bolkey, Thomas J. Morrow

It is certified that error appears in the above-indentified patent and that said Letters Patent is hereby corrected as shown below:

Claim 2, column 8, line 31, "mean" should be -- means --.

Claim 5, column 9, line 32, "defining" should be -- redefining --.

Claim 7, column 9, line 61, "stand" should be -- stands --.

Claim 10, column 10, line 31, after second occurrence "stand", "." should be -- , --.

Claim 13, column 12, line 6, "output" should be -- pivot --.

Signed and Sealed this

Twenty-eight Day of March, 1995

Bruce Lehman

*Attest:*

BRUCE LEHMAN

*Attesting Officer*

*Commissioner of Patents and Trademarks*